US011739548B2

(12) United States Patent
Tulett et al.

(10) Patent No.: US 11,739,548 B2
(45) **Date of Patent: *Aug. 29, 2023**

(54) SPA STRUCTURAL SUPPORT ASSEMBLY

(71) Applicant: BULLFROG INTERNATIONAL, LC, Herriman, UT (US)

(72) Inventors: Nathan Tulett, Pleasant Grove, UT (US); Eric Hales, Eagle Mountain, UT (US); Creed Larsen, Murray, UT (US); Mark McLane, Lehi, UT (US); Todd Andersen, Lehi, UT (US); Chris Lundell, Lehi, UT (US); Richard Alex Eddington, South Jordan, UT (US)

(73) Assignee: Bullfrog International, LC, Herriman, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/901,528

(22) Filed: Sep. 1, 2022

(65) Prior Publication Data

US 2022/0412111 A1 Dec. 29, 2022

Related U.S. Application Data

(63) Continuation of application No. 17/028,346, filed on Sep. 22, 2020, now Pat. No. 11,447,969.

(60) Provisional application No. 62/906,493, filed on Sep. 26, 2019.

(51) Int. Cl.
*E04H 4/00* (2006.01)

(52) U.S. Cl.
CPC ..... *E04H 4/0037* (2013.01)

(58) Field of Classification Search
CPC ..... E04H 4/0037; E04H 4/005; E04H 4/0043
See application file for complete search history.

(56) References Cited

U.S. PATENT DOCUMENTS 9,572,459 B2 * 2/2017 Dragovic ..... A61H 33/6005

* cited by examiner

*Primary Examiner* — Janie M Loeppke
(74) *Attorney, Agent, or Firm* — Dentons Durham Jones Pinegar; Sarah W. Matthews

(57) ABSTRACT

A structural support system for a spa can include: a vertical support comprising a first portion and a second portion and a first side and a second side, wherein the first portion is comprised of a plurality of shaped openings being open on the first side and wherein the second portion is comprised of a plurality of shaped openings being open on the second side; a channel bracket, the channel bracket comprising a shaped boss on a first side and a first groove formed in a second side, wherein channel bracket further comprises a second groove formed in a third side, the third side being opposite the second side; and a spa panel retention member, the spa panel retention member comprising a projection to mate in the first groove of the channel bracket.

20 Claims, 13 Drawing Sheets

SPA STRUCTURAL SUPPORT ASSEMBLY

PRIORITY CLAIM

The present disclosure claims priority under 35 U.S.C. § 120 for the benefit of the prior-filed non-provisional application Ser. No. 17/028,346 ("the '346 Nonprovisional"), filed 22 Sep. 2020, which claims priority under 35 U.S.C. § 119(e) for the benefit of prior-filed provisional application No. 62/906,493, filed 26 Sep. 2019 ("the '493 Provisional"). Both the '346 Nonprovisional and the '493 Provisional application are incorporated herein by reference in their entireties.

TECHNICAL FIELD

The present disclosure relates generally to spas. More specifically, the present disclosure relates to a system and method of construction for a support assembly for a spa.

BACKGROUND

Spas are well-known for leisure. Large spas comprise a spa shell that is held within a base by a frame. The spa shell and its associated wiring, tubing, etc., is not aesthetically pleasing, so a cabinet or other assembly is typically provided around the frame to provide a more aesthetically pleasing look. In many cases, the cabinet assembly is made by building a wooden or metal frame and then securing to that frame a plurality of rigid individually manufactured panels utilizing fastening members such as screws. Then, if this cabinet assembly is built separate from the spa, the spa must be either placed within the cabinet assembly or the cabinet assembly placed around the spa. If any maintenance is required on the spa, the cabinet assembly often must be removed. Additionally, many components such as water lines, controllers, etc., are contained within the cabinet, often in a haphazard manner.

Some or all of the problems, difficulties and drawbacks identified above, and other problems, difficulties, and drawbacks may be helped or solved by the spa structural assembly system shown and described herein. The system may also be used to address other problems, difficulties, and drawbacks not set out above or which are only understood or appreciated at a later time. The future may also bring to light currently unknown or unrecognized benefits which may be appreciated, or more fully appreciated, in the future associated with the novel invention shown and described herein.

SUMMARY

A structural support system for a spa may include a plurality of vertical supports, at least one of the plurality of vertical supports comprising a first portion and a second portion and a first side and a second side. The first portion is comprised of a plurality of polygons being open on the first side and the second portion is comprised of a plurality of polygons being open on the second side. The system may also include at least one channel bracket, with the channel bracket comprising a polygonal boss on a first side and a first groove formed in a second side. The system may further include and at least one spa panel retention member, with the spa panel retention member comprising a projection to mate in the first groove of the channel bracket.

According to one aspect, the spa panel retention member may comprise a channel, with the channel having a base and two lateral projections. The two lateral projections of the spa panel retention member may comprise a first lateral projection and a second lateral projection, and a first space for holding a spa panel may be formed between the first lateral projection and the channel bracket, and a second space for holding a spa panel may be formed between the second lateral projection and the channel bracket. In some configurations, the projection to mate in the first groove of the channel bracket comprises a cylindrical rib extending from the base of the channel bracket.

According to another aspect, the at least one channel bracket may further comprise a second groove formed in a third side, the third side being opposite the second side. In some configurations, the first groove and the second groove may have a semi-circular shape. The channel bracket may include at least one dampener, and in some configurations, the channel bracket comprises four dampeners, one on each side of the first groove and second groove. The space (e.g., the first and/or second spaces) for holding the spa panel may be formed between a dampener and the spa panel retention member.

In some configurations, the vertical supports are formed of a plurality of connected hex cells. The shaped boss, especially the polygonal boss of the channel bracket, may have a hexagonal shape, or any suitable shape.

According to another aspect, a system for forming or supporting a spa may include a plurality of vertical supports, with at least one of the plurality of vertical supports comprising a first portion, a second portion, a first side, and a second side. The first portion may be comprised of a plurality of contiguous hexagons being open on the first side and substantially closed on the second side, with at least one perforation through the second side. The second portion may be comprised of a plurality of contiguous hexagons being open on the second side and substantially closed on the first side, with at least one perforation through the first side. The system may also include at least one channel bracket, with the at least one channel bracket comprising a hexagonal boss on a first side configured to mate with one of the plurality of contiguous hexagons. The at least one channel bracket may also comprise a projection on the first side configured to mate with one of the perforations, a first groove formed in a second side and a second groove formed in a third side, where the second side is opposite the third side. The system may further include a spa panel retention member comprising a projection to mate in the first groove or second groove of the channel bracket.

According to yet another aspect, a system for forming or supporting spa may include a plurality of vertical supports, with at least one of the plurality of vertical supports comprising a top and a bottom. The system may also include a plurality of first vertical attachment members to attach to a spa shell and a plurality of second vertical attachment members having a top side and a bottom side. In some embodiments the top side is for attachment to the first vertical attachment member and the bottom side is for removable attachment to the top of one of the plurality of vertical supports. A connection between the bottom side of the second vertical attachment members and the top of the vertical supports allows the vertical supports to move in a plane perpendicular to a sidewall of the spa. The system may further include a plurality of third vertical attachment members having a top side and a bottom side, with the top side for removable attachment to the bottom of one of the plurality of vertical supports. The system may be a structural support system.

In some configurations, the plurality of vertical supports may be removed from a spa structure and replaced. The connection between the bottom side of the second vertical attachment members and the top of the vertical supports may comprise a tongue and groove connection.

BRIEF DESCRIPTION OF DRAWINGS

The following drawings illustrate what are currently considered to be specific representative configurations for carrying out the invention and are not limiting as to embodiments which may be made in accordance with the present invention. The components in the drawings are not necessarily to scale relative to each other. Like reference numerals designate corresponding parts throughout the several views.

The drawings are illustrative and not limiting of the scope of the invention which is defined by the appended claims. The various elements of the invention accomplish various aspects and objects of the invention. Not every element of the invention can be clearly displayed in a single drawing, and as such not every drawing shows each element of the invention.

DETAILED DESCRIPTION

Figure 1:
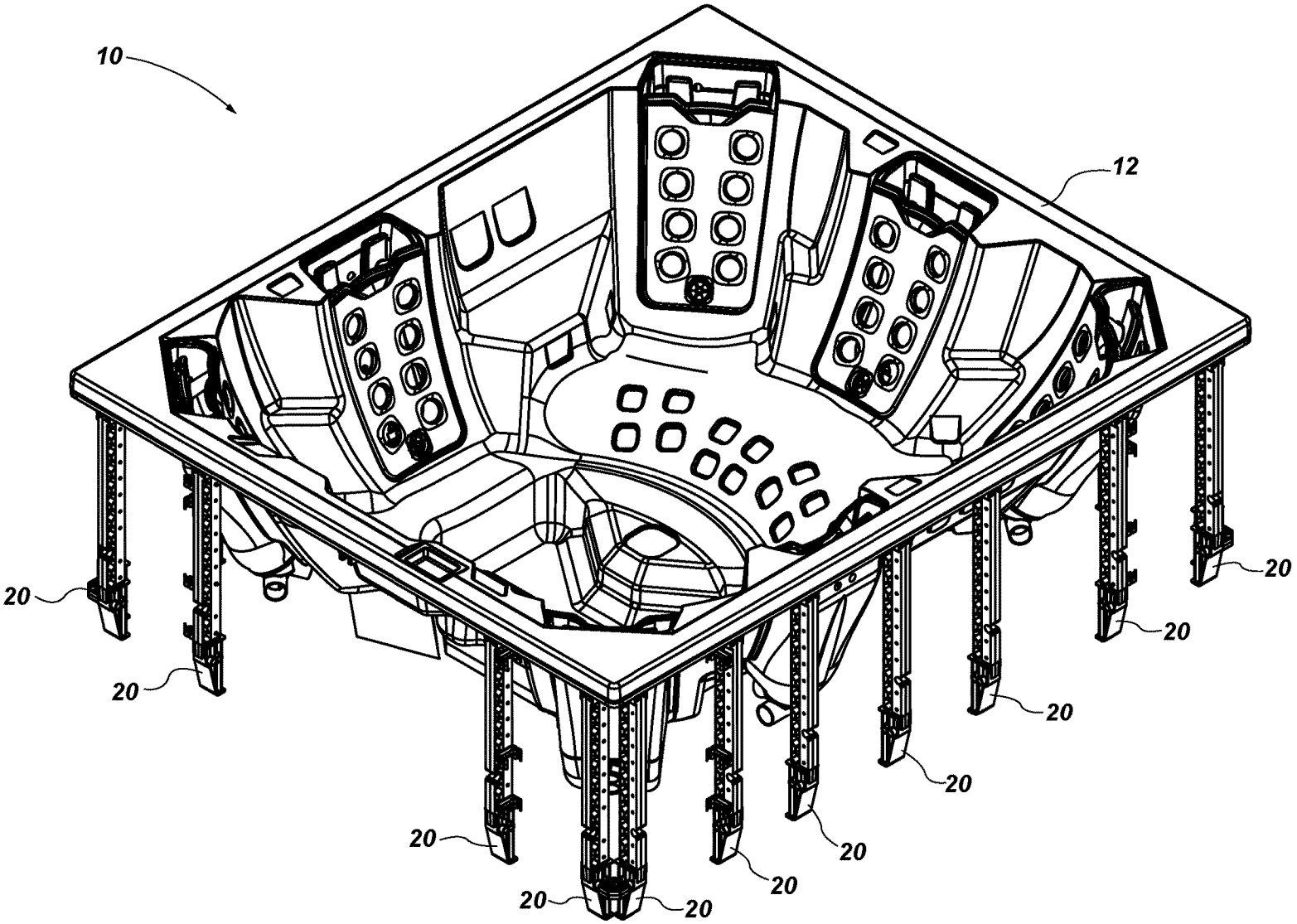
FIG. 1 shows a perspective view of a structural assembly for a spa.

Hereinafter, exemplary embodiments of the present disclosure will be described in detail with reference to the accompanying drawings. Advantages and features of the present disclosure and methods accomplishing them will become apparent from the following description of exemplary embodiments with reference to the accompanying drawings.

It will be appreciated that various aspects discussed in one drawing may be present and/or used in conjunction with the embodiment shown in another drawing, and each element shown in multiple drawings may be discussed only once.

Reference in the specification to "one configuration," "one embodiment," "a configuration," or "an embodiment" means that a particular feature, structure, or characteristic described in connection with the configuration is included in at least one configuration, but is not a requirement that such feature, structure, or characteristic be present in any particular configuration unless expressly set forth in the claims as being present. The appearances of the phrase "in one configuration" in various places may not necessarily limit the inclusion of a particular element of the invention to a single configuration, rather the element may be included in other or all configurations discussed herein.

Furthermore, the described features, structures, or characteristics of configurations of the invention may be combined in any suitable manner in one or more configurations. In the following description, numerous specific details are provided, such as examples of products or manufacturing techniques that may be used, to provide a thorough understanding of configurations of the invention. One skilled in the relevant art will recognize, however, that configurations of the invention may be practiced without one or more of the specific details, or with other methods, components, materials, and so forth. In other instances, well-known structures, materials, or operations are not shown or described in detail to avoid obscuring aspects of the invention.

It should also be noted that, as used in this specification and the appended claims, singular forms such as "a," "an," and "the" may include the plural unless the context clearly dictates otherwise. Thus, for example, reference to "a vertical support" may include one or more of such vertical supports, and reference to "the hex cell" may include reference to one or more of such hex cells.

As used herein, a plurality of items, structural elements, compositional elements, and/or materials may be presented in a common list for convenience. However, these lists should be construed as though each member of the list is individually identified as a separate and unique member.

Numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually. This same principle applies to ranges reciting only one numerical value as a minimum or a maximum. Furthermore, such an interpretation should apply regardless of the breadth of the range or the characteristics being described.

Figure 11:
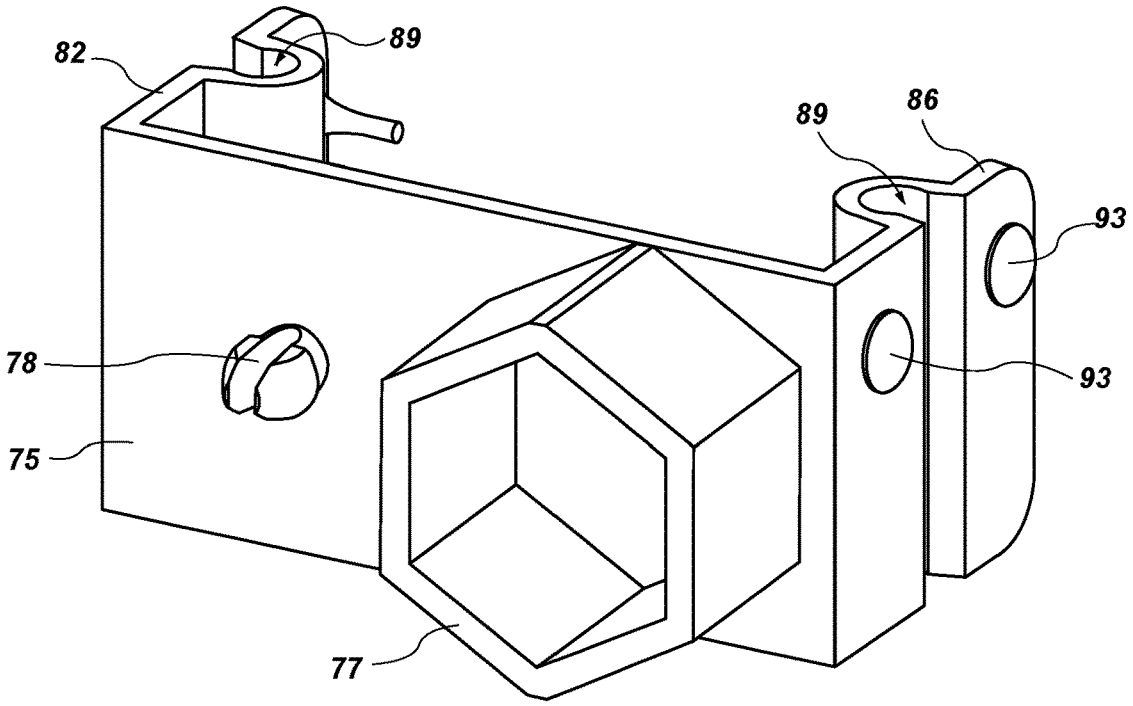
FIG. 11 shows another perspective view of the channel bracket of FIG. 10.

The present disclosure generally relates to a system 10 for supporting a spa structure 12. The system 10 may generally include one or more vertical supports 20 (FIG. 11). The number of vertical supports 20 may vary depending on the size and shape of the spa 12. According to one aspect, the vertical supports 20 may have a top side for attachment to a spa shell 12 and a bottom side for attachment to a spa base. As described in more detail below, this attachment may be removable such that the vertical supports 20 may be removed and replaced from the spa structure during maintenance.

Figure 2:
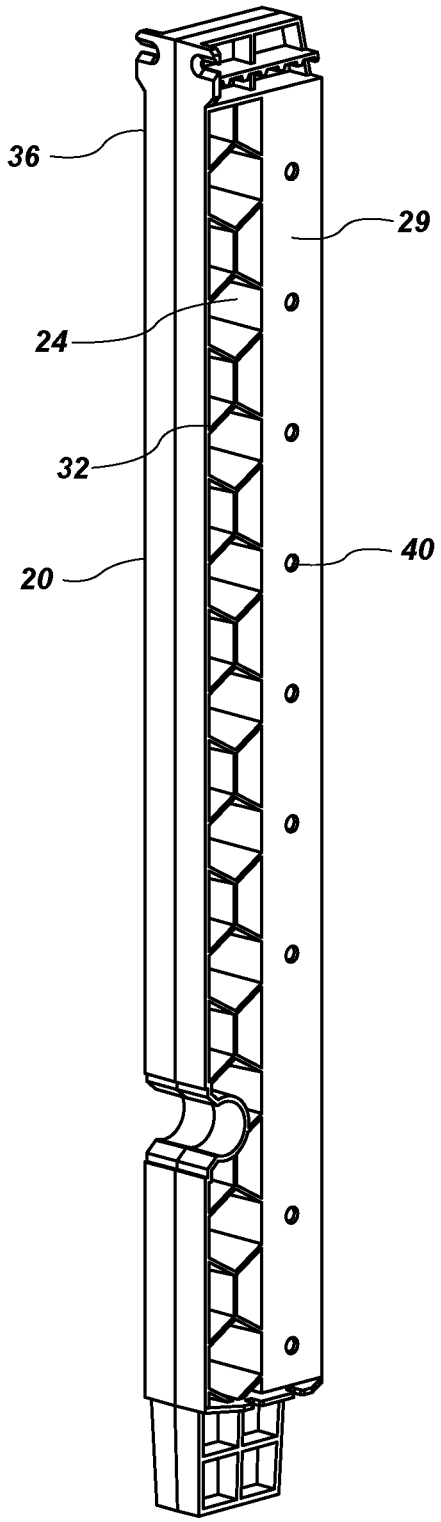
FIG. 2 shows a perspective view of one configuration of a vertical support.
Figure 3:
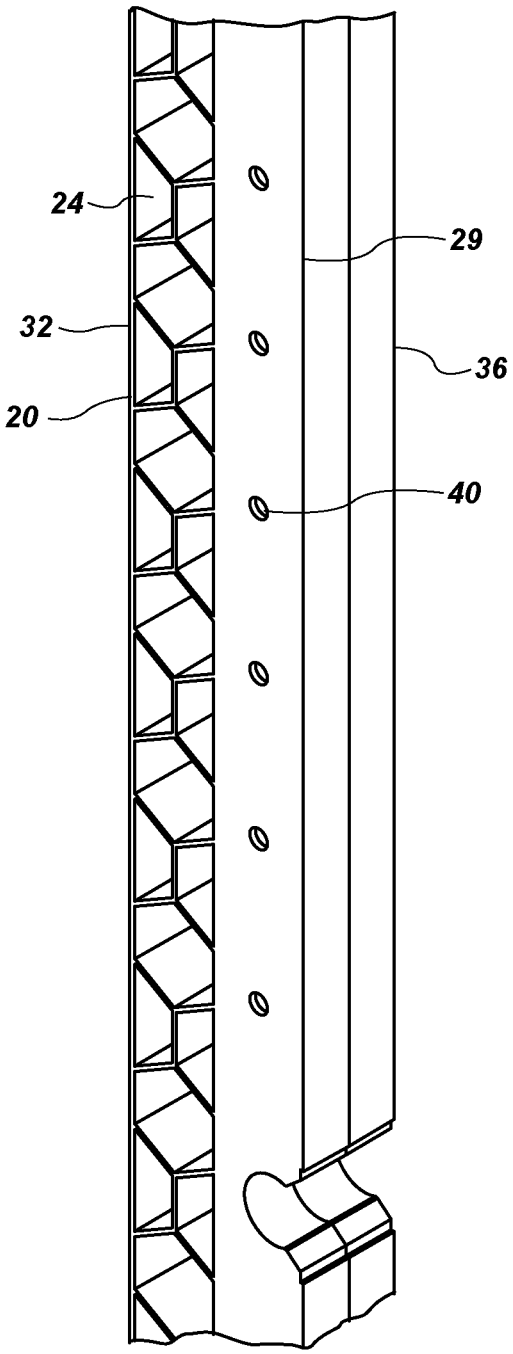
FIG. 3 shows a partial close-up perspective view of the vertical support of FIG. 2.

As seen in FIGS. 2-3, in some configurations, the vertical supports 20 may each include a first portion 24 extending the length of the vertical support 20 and a second portion 29 extending the length of the vertical support 20, as well as a first side 32 and a second side 36. The first portion 24 and second portion 29 may be formed with polygons shaped therein that are open on one side, or in other words, shaped openings. For example, circles, squares, triangles, arcs, etc., may be formed in one or more of the first portion 24 and second portion 29. These shapes may give structure to the vertical supports 20 and may also allow for modular attachment of other components as described below. As used herein, "polygon" means any geometric shape, including shapes with straight sides, curved sides, shapes which are closed, shapes which are open, shapes with regular angles, and shapes with irregular angles. The first portion 24 and the second portion 29 may each have the same type of polygon or shaped opening; or in some configurations, the first portion 24 may have one type of polygon or shaped opening formed therein, and the second portion 29 may have another type of polygon or shaped opening formed therein.

In one configuration, shown in FIGS. 2-3, the first portion 24 and second portion 29 are formed of continuous hexagons being open on one side. The first portion 24 may have hexagons open on a first side 32, while the second portion 29 may have hexagons open on a second side 36. Additionally, the first portion 24 may have one or more perforations 40 formed on a second side 36 to further aid in attachment of components to the vertical supports 20. The second portion 29 may similarly have one or more perforations 40 formed on a first side 32. In other configurations, the vertical supports 20 may have fewer or more shaped holes/openings for modular connections, or no shaped holes/openings. In some implementations, the vertical support members 20 may be substantially solid.

According to one aspect, the vertical supports 20 may be connected to the spa structure 12 in a removable manner. This may allow the vertical supports 20 to be removed during maintenance and/or to be easily replaced if one breaks. For example, a first vertical attachment member 44 may be attached to a spa shell 12 (FIGS. 4-5), and a second vertical attachment member 47 may be connected on a top side 51 thereof, to the first vertical attachment member 44 and on a bottom side 54 thereof, to the vertical support 20. The second vertical attachment member 47 may comprise a groove 67 formed in the bottom side 54 thereof. The groove 67 may extend from a distal side, or side facing the outside of the spa 12, to a proximal side, or side facing the inside of the spa 12. This may restrict movement of the vertical support 20 located within the groove 67 to movement perpendicular to a spa sidewall. That is, the vertical support 20 can only move inwardly and outwardly relative to the spa sidewall.

The connection between the top of the vertical support 20 and the second vertical attachment member 47 may be, for example, a tongue-and-groove attachment or other slideable and/or detachable mating attachment. This type of connection between the second vertical attachment member 47 and vertical supports 20 may allow the vertical supports 20 to move in a plane perpendicular to a sidewall of the spa 12. The corners of the spa shell 12 may have similar first vertical attachment members 44, or in some configurations, may have a corner-type first vertical attachment member 44*a* that includes one or more bends (FIG. 6).

Figure 4:
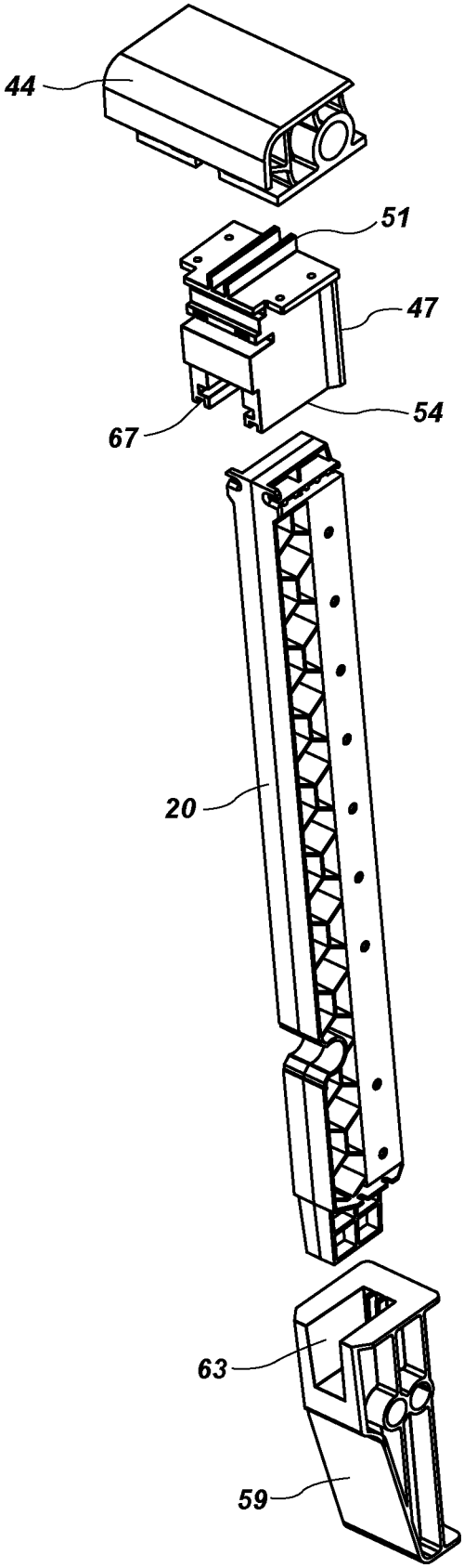
FIG. 4 shows an exploded view of a vertical support and vertical attachment members.
Figure 5:
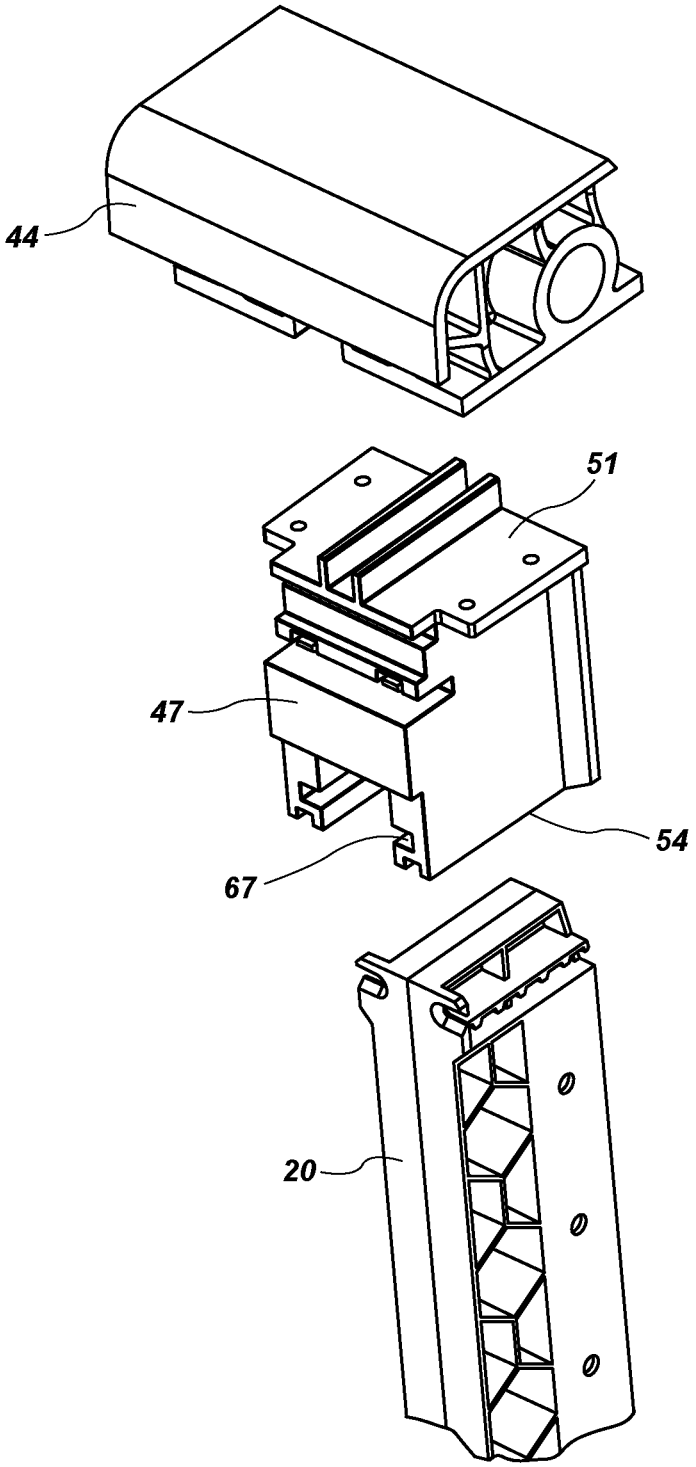
FIG. 5 shows a partial close-up of the exploded view of FIG. 4.
Figure 6:
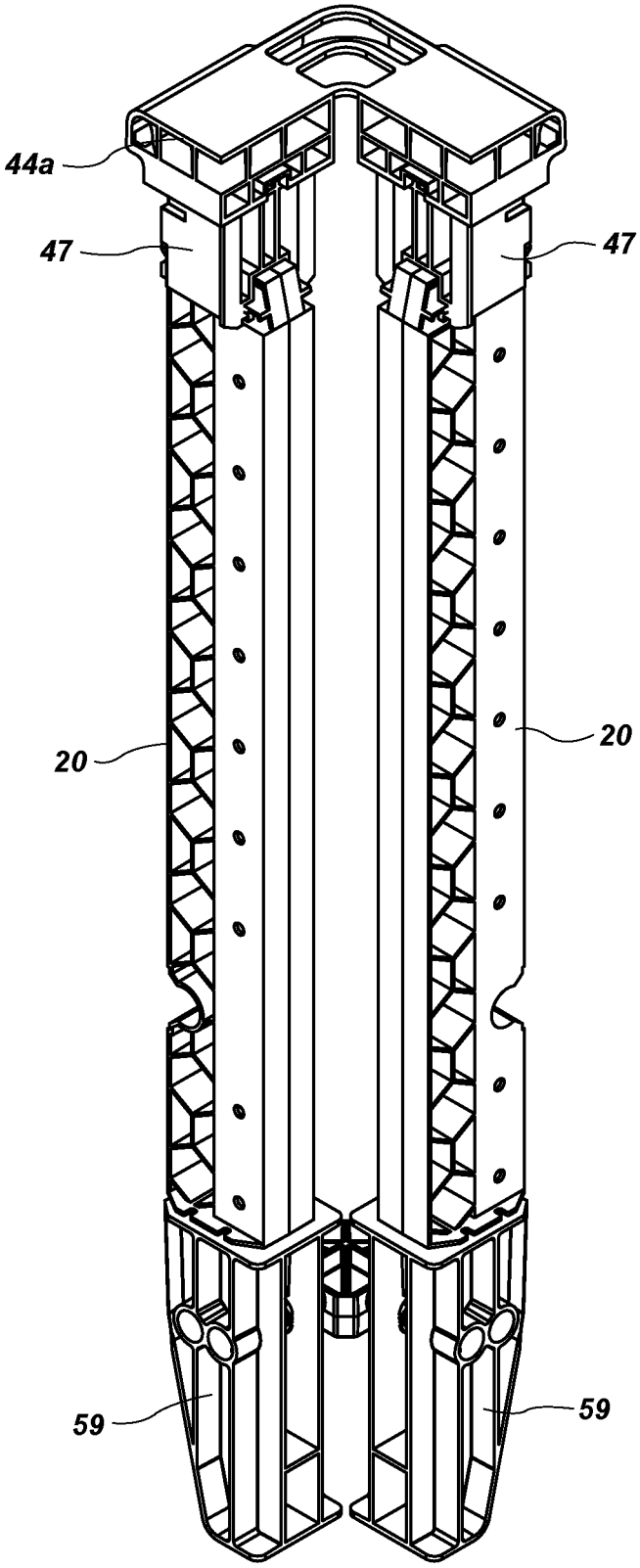
FIG. 6 shows a perspective view of vertical supports and corner-type vertical attachment members.
Figure 7:
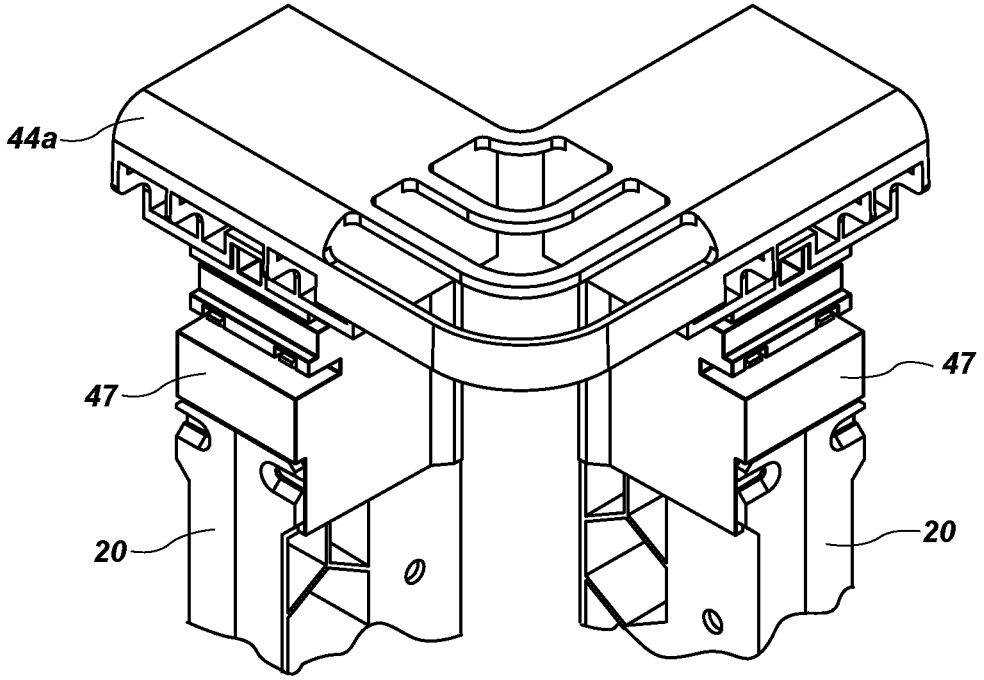
FIG. 7 shows a partial close-up of the vertical supports and corner-type vertical attachment members of FIG. 6.
Figure 8:
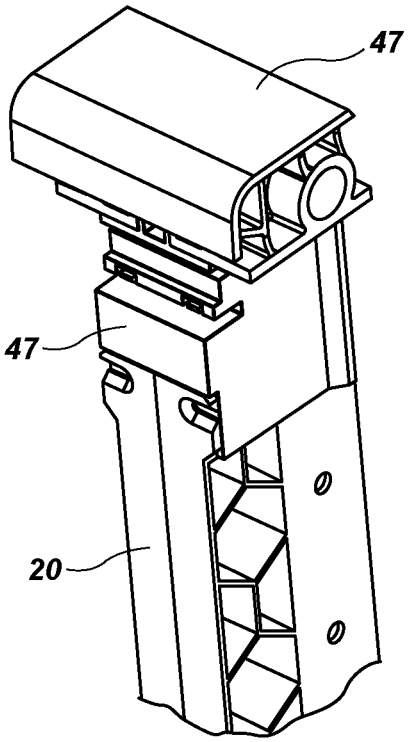
FIG. 8 shows a partial close-up of a vertical support and vertical attachment members in a connected configuration.

Similarly, the attachment of the vertical supports 20 to the spa base may be through a third vertical attachment member 59 (see FIGS. 4 & 6). Third vertical attachment member 59 may include a groove 63, as well as a portion that can mate with or otherwise attach to a spa base. The attachment between the vertical support 20 and the spa base may also be removable in some configurations to allow vertical supports 20 to be removed from the spa structure 12 and replaced for maintenance, etc. For example, the bottom of the vertical support 20 may slidably fit with the groove 63 of the third vertical attachment member 59 and at the top of the vertical support 20, slidably fit with the groove 67 of the second vertical attachment member 47.

Figure 9:
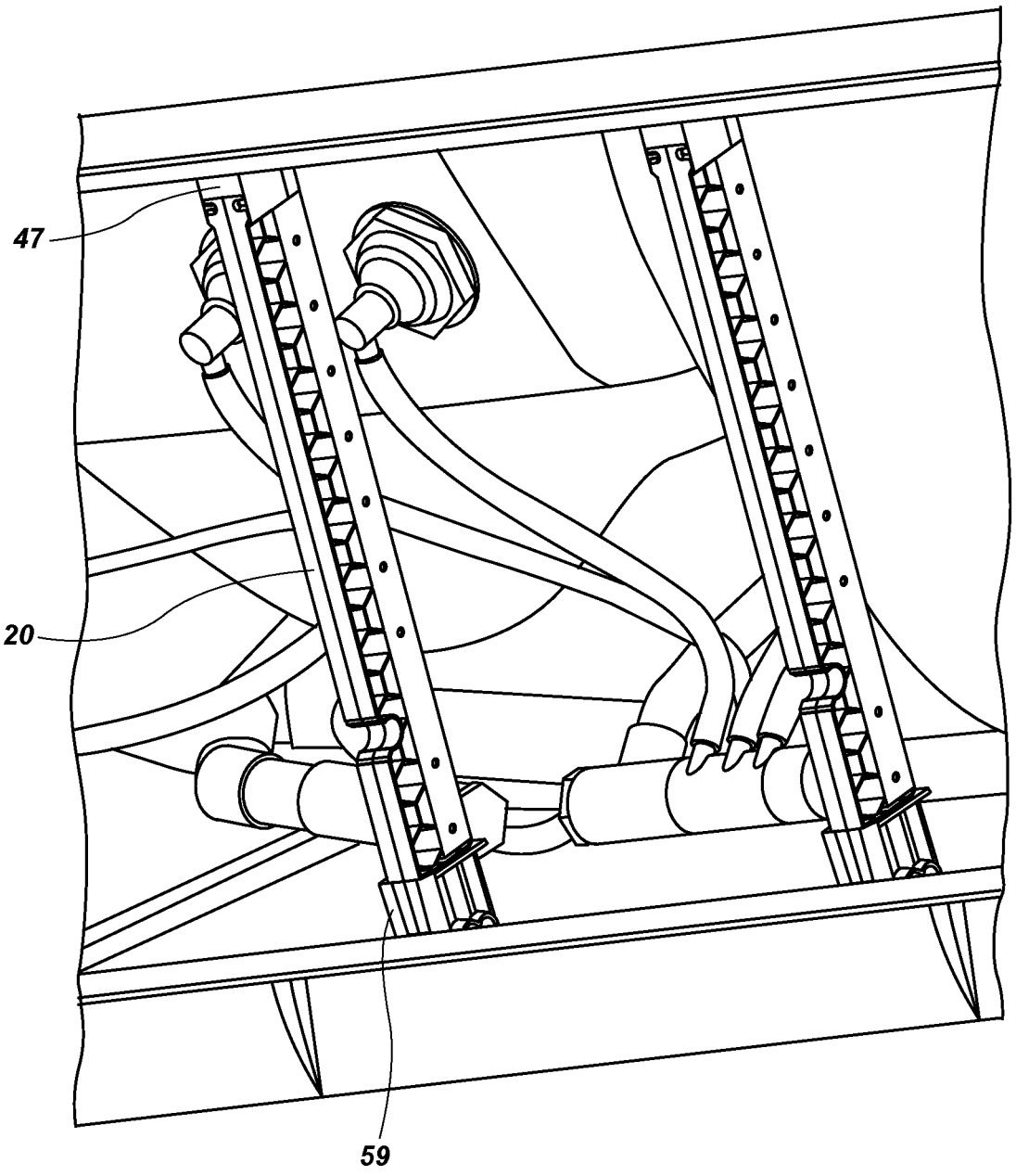
FIG. 9 shows a perspective view of vertical supports attached to the spa shell and spa base.

FIG. 9 shows a perspective view of a spa structural assembly 10 without side panels in place, and it can be seen that the vertical supports 20 could be slid outwardly away from the structural assembly 10 without the need for tools. Easily removable vertical supports 20 may assist in access to the spa for maintenance and also in replacement of the vertical supports 20 if one is damaged. A slideable connection of the vertical supports 20 to the spa 12 structure may also restrict movement of the vertical supports 20 to a plane perpendicular to a sidewall of the spa 12. This may allow the spa shell 12 to self-center within the spa support structure 10.

Figure 10:
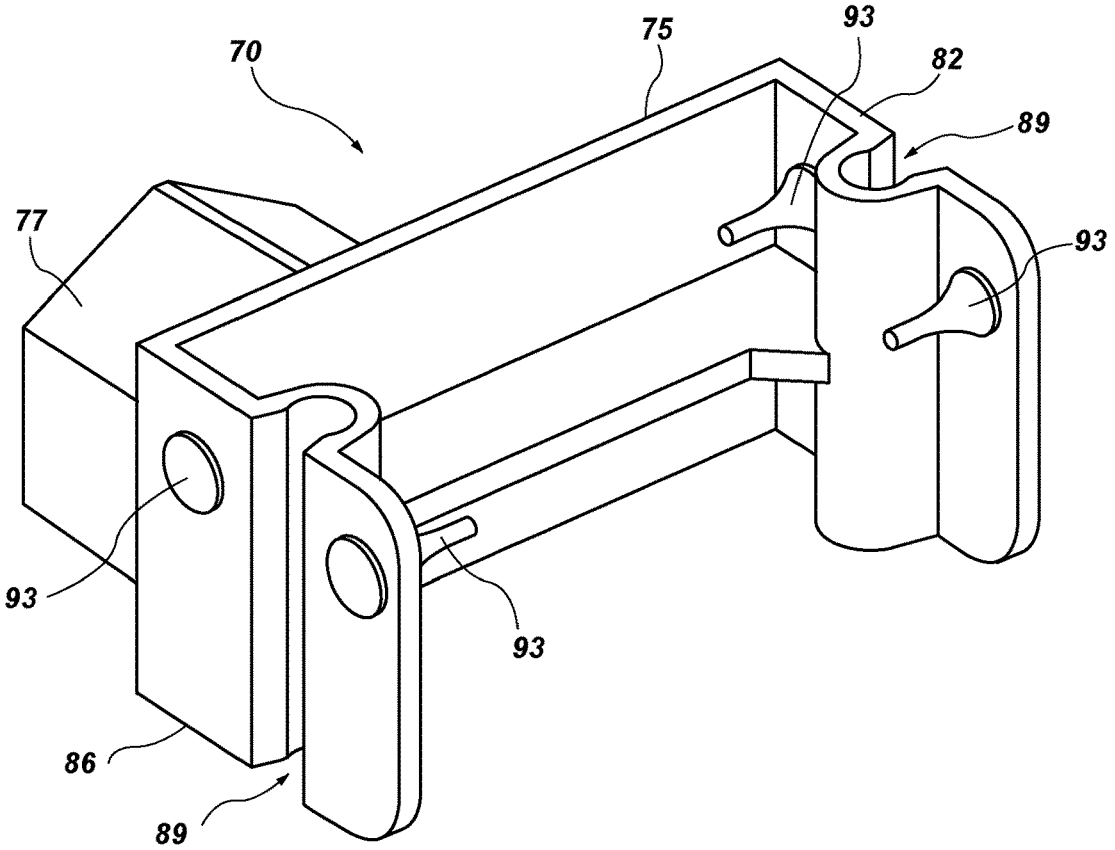
FIG. 10 shows a perspective view of a channel bracket.

According to another aspect, one or more structures may be attached to vertical supports 20. For example, a channel bracket 70 (FIGS. 10-11) may be provided. The channel bracket 70 may include a first side 75 having a shaped or polygonal boss 77 projecting therefrom. The polygonal boss 77 may have a structure that mates with the open side of either the first portion 24 or second portion 29 of the vertical support 20. For example, polygonal boss 77 may have a hexagonal shape to fit within one or more of the hexagons provided in the vertical support 20 . Other shapes are also contemplated. The first side 75 of the channel bracket 70 may also include a projection 78 to mate with one or more of the perforations 40 of the vertical support 20. The projection 78 may be, for example, a snap-fit projection or other projection to be received by a perforation 40.

The channel bracket 70 may have a second side 82 and third side 86. One or more of the second side 82 and/or third side 86 may have a channel or groove 89 formed therein. As discussed in more detail below, this may allow connection of a spa panel retention member without the need to use tools. In some configurations, the second side 82 and third side 86 may both have a channel or groove 89 formed therein. In other configurations, only one channel or groove 89 may be provided. Where a channel or groove 89 is formed in both the second side 82 and third side 86, the channel bracket 70 may be reversible such that the same channel bracket 70 may mate with a first side 32 of the vertical support 20 and/or a second side 36 of the vertical support 20. The channel or groove 89 may have a C-shape or a semi-circular shape. Other shapes are contemplated and may be used for the channel or groove 89.

The channel bracket 70 may further comprise one or more dampeners 93. The one or more dampeners 93 may be formed of a material such as rubber, and may dampen vibration of spa panels that are held in place against the channel bracket 70 as described in more detail below. In some configurations, four dampeners 93 may be provided, one on each side 82, 86 of the groove 89 on each side of the channel bracket 70.

Figure 12:
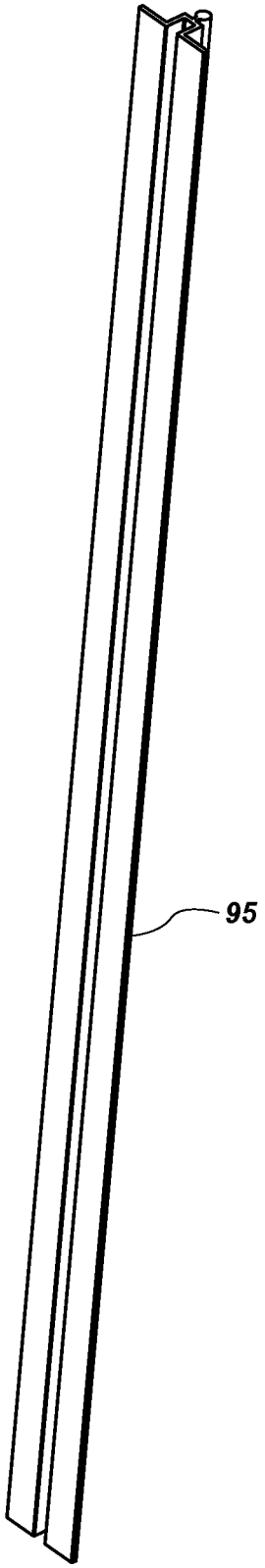
FIG. 12 shows a perspective view of a spa panel retention member.
Figure 13:
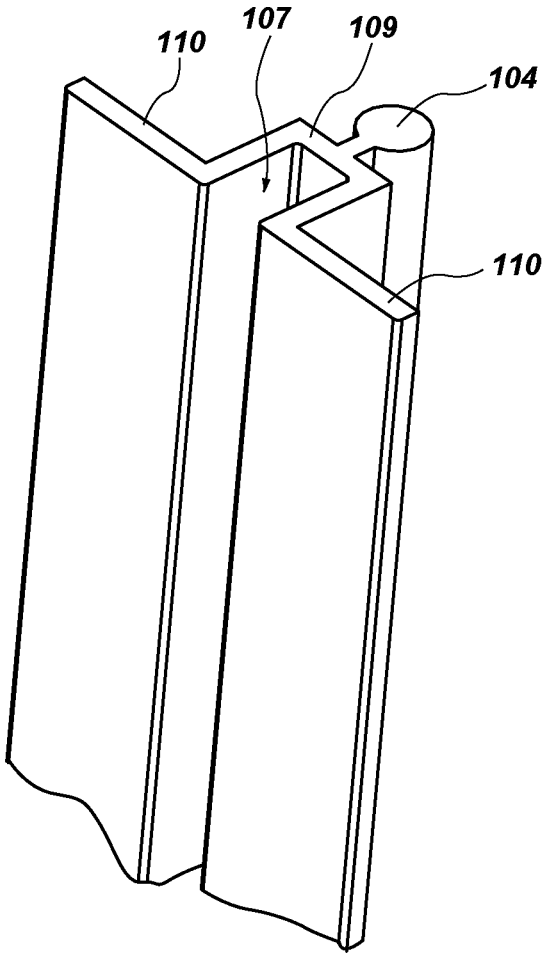
FIG. 13 shows a close-up view of the spa panel retention member of FIG. 12.
Figure 14:
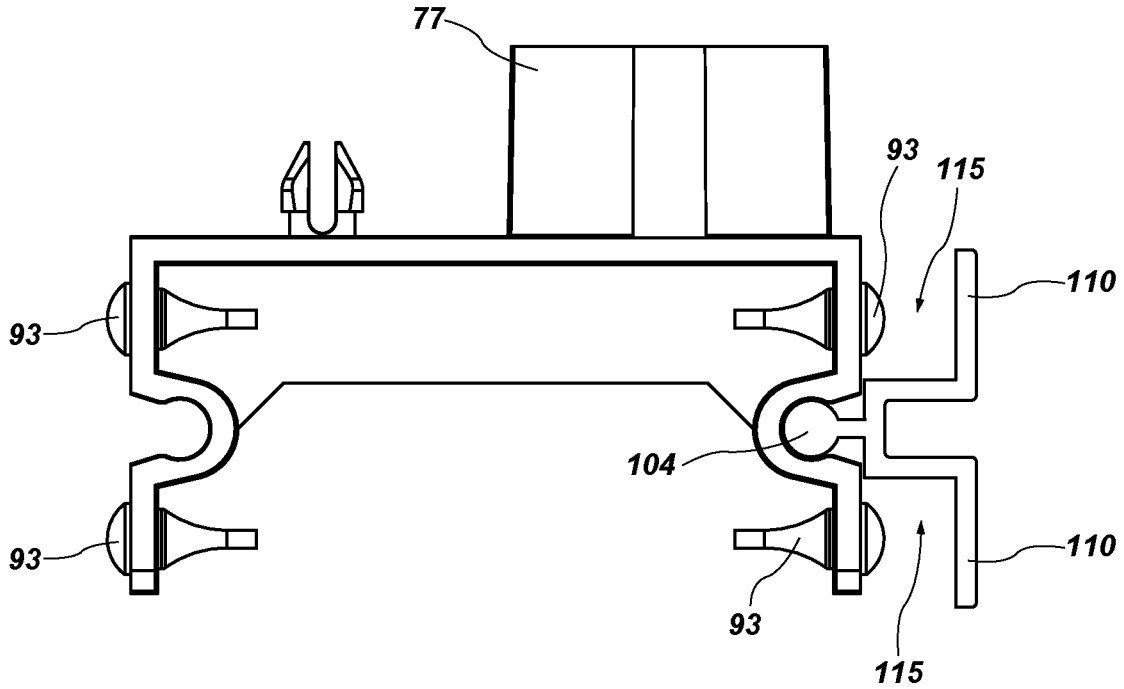
FIG. 14 shows a top view of a channel bracket connected to a spa panel retention member.
Figure 15:
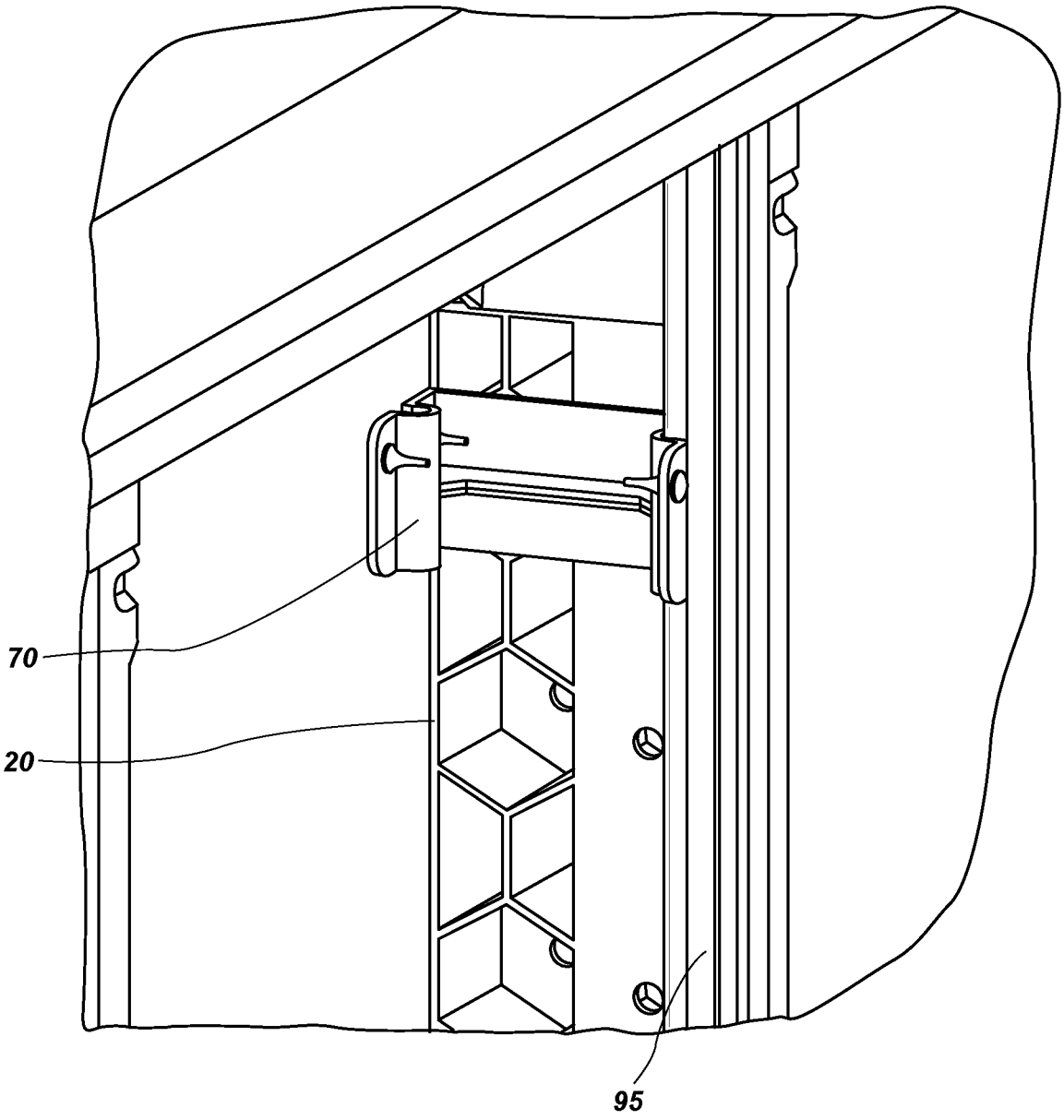
FIG. 15 shows a perspective view of a spa shell having a vertical support in place, a channel bracket attached to the vertical support, and a spa panel retention member attached to the channel bracket.

The structural assembly 10 may further include at least one spa panel retention member 95 (FIGS. 12-13). The spa panel retention member 95 may include a projection 104 to mate in the groove 89 of the channel bracket 70 (FIG. 14). The spa panel retention member 95 may generally comprise an open channel 107 with a base 109, and two lateral projections 110. The projection 104 to mate in the groove 89 of the channel bracket 10 may comprise a cylindrical rib extending from the base 109 of the channel 107. Other types of shapes, etc., may be used for the spa panel retention member 95 and the channel bracket 70 to mate. Other types of connections, such as non-removable connections, are also possible.

The shape of the spa panel retention member 95 may allow the spa panel retention member 95 to mate with the groove 89 of the channel bracket 70, and form a space 115, or void, to receive a spa panel (not shown in FIG. 14). The spa panel may thus be held in place against the channel bracket 70 on the inside, and the spa panel retention member 95 on the outside, or more particularly, the lateral projections 110 of the spa panel retention member 95. If provided, dampeners 93 on the channel bracket 70 may assist in holding the spa panel in place and dampening any vibrations of the spa panel.

It will be appreciated that the connections as described herein may allow a simplified, somewhat modular construction of a spa structural support. The connections as described herein may also allow simple removal of portions of the spa structural support for maintenance. For example, if the spa 12 requires maintenance, a user may slide the spa panel retention member 95 out of its engagement with a channel bracket 70. The spa panel can then be removed. And if additional access is required or desired, one or more vertical supports 20 can be slid outwardly from their connection to the spa 12.

Figure 16:
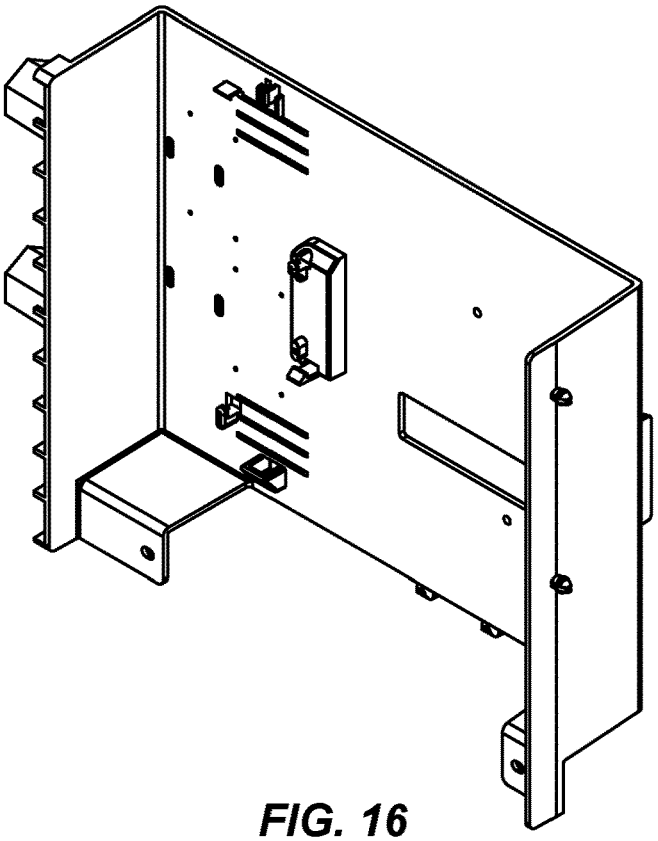
FIG. 16 shows a front perspective view of a modular shelf for connection to the vertical supports.
Figure 17:
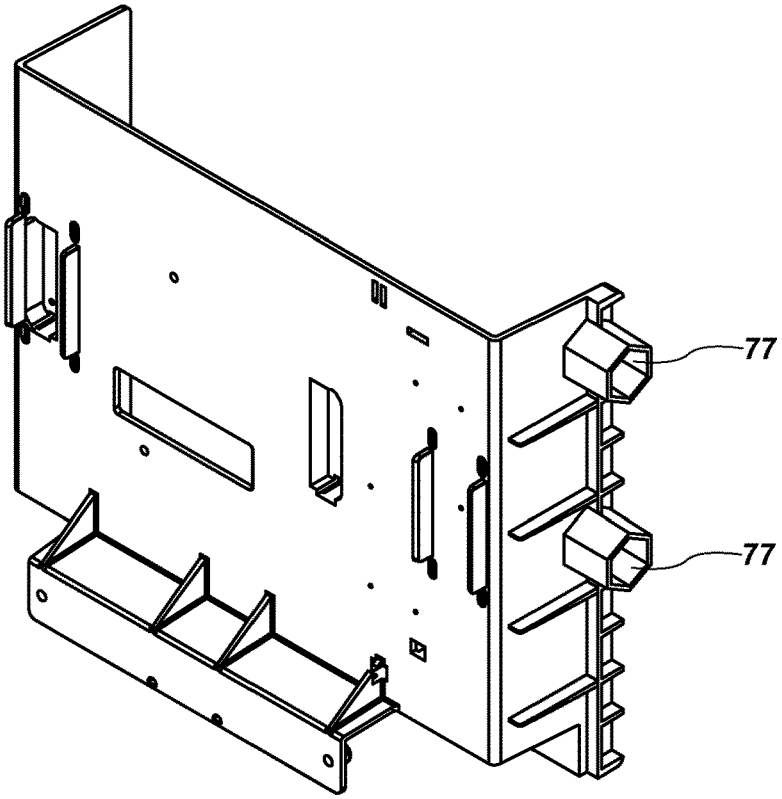
FIG. 17 shows a rear perspective view of the modular shelf of FIG. 16.
Figure 18:
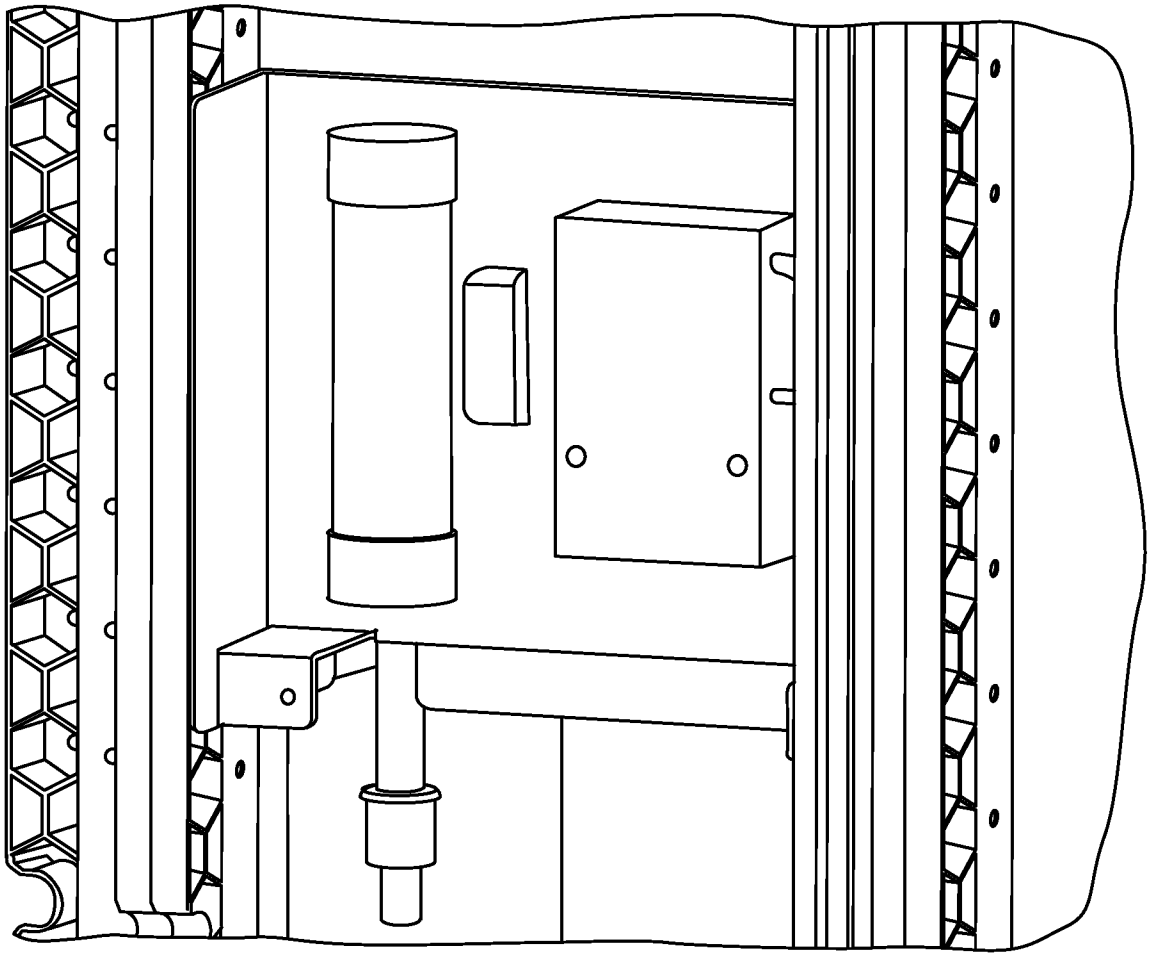
FIG. 18 shows a perspective view of the modular shelf of FIGS. 16-17 in place on vertical supports.

Additionally, the modular configuration of the vertical supports 20 allows structures within the spa cabinet assembly to be attached directly to the vertical supports 20. For example, in addition to the channel brackets 70 described above for attachment of spa paneling, interior structures may also be connected to the vertical supports 20. In some configurations, controllers, etc., may be housed in or attached to panels connected to vertical supports 20. FIGS. 16-17 show a modular shelf that may be provided with one or more bosses 77 for connection to vertical supports 20, and FIG. 18 shows the modular shelf in place in the spa structural support. Such modular shelves may be used to house or otherwise store wiring, controllers, etc., that normally would not have a particular placement within the spa cabinet.

The various embodiments described above, including elements of the various embodiments described above, can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

Various portions and components of apparatus within the scope of the inventions, including for example, structural components, can be formed by one or more various suitable manufacturing processes known to those in the art. Similarly, various portions and components of apparatuses within the scope of the inventions can be made from suitable materials known to those in the art.

The above description has set out various features, functions, methods and other aspects of the disclosure. This has been done with regard to the current embodiments thereof. Time and further development may change the manner in which the various aspects are implemented. For example, the disclosure is specifically discussed with applications to spa support structures. However, the system may have other applications outside spa support structures.

The scope of protection accorded the inventions as defined by the claims is not intended to be limited to the specific sizes, shapes, features or other aspects of the current embodiments shown and described. The claimed invention may be implemented or embodied in other forms while still being within the concepts shown, described and claimed herein. Also included are equivalents of the inventions which can be made without departing from the scope of concepts properly protected hereby.

We claim:

1. A structural support system for a spa, the structural support system comprising:

a vertical support comprising a first portion and a second portion and a first side and a second side, wherein the first portion is comprised of a plurality of shaped openings being open on the first side and wherein the second portion is comprised of a plurality of shaped openings being open on the second side;

a channel bracket, the channel bracket comprising a shaped boss on a first side and a first groove formed in a second side, wherein channel bracket further comprises a second groove formed in a third side, the third side being opposite the second side; and a spa panel retention member, the spa panel retention member comprising a projection to mate in the first groove of the channel bracket.

2. The structural support system for a spa of claim 1, wherein the spa panel retention member comprises a channel, the channel having a base and two lateral projections.

3. The structural support system for a spa of claim 2, wherein the two lateral projections of the spa panel retention member comprise a first lateral projection and a second lateral projection, and wherein a first space for holding a spa panel is formed between the first lateral projection and the channel bracket, and wherein a second space for holding the spa panel is formed between the second lateral projection and the channel bracket.

4. The structural support system for a spa of claim 1, wherein the projection to mate in the first groove of the channel bracket comprises a cylindrical rib extending from a base of the spa panel retention member.

5. The structural support system for a spa of claim 1, wherein the first groove and the second groove have a semi-circular shape.

6. The structural support system for a spa of claim 5, wherein the channel bracket further comprises one dampener.

7. The structural support system for a spa of claim 6, wherein the channel bracket comprises a first dampener and a second dampener, the first dampener and the second dampener on opposing sides of the first groove, and wherein the channel bracket comprises a third dampener and a fourth dampener, the third dampener and the fourth dampener on opposing sides of the second groove.

8. The structural support system for a spa of claim 7, wherein a first space for holding a spa panel is formed between a dampener and the spa panel retention member.

9. The structural support system for a spa of claim 1, wherein the plurality of vertical supports are formed of a plurality of connected hex cells.

10. The structural support system for a spa of claim 9, wherein the shaped boss of the channel bracket has a hexagonal shape.

11. The structural support system for a spa of claim 1, further comprising:

the vertical support comprising a top and a bottom;

a first vertical attachment member to attach to a spa shell;

a second vertical attachment member having a top side and a bottom side, the top side for attachment to a bottom side of the first vertical attachment member and the bottom side for removable attachment to the top of the vertical support, a connection between the bottom side of the second vertical attachment member and top of the vertical support allowing the vertical support to move inwardly and outwardly with respect to a sidewall of the spa; and a third vertical attachment member having a top side and a bottom side, the top side for removable attachment to the bottom of the vertical support.

12. A spa support system, the spa support system comprising:

a vertical support comprising a first portion and a second portion and a first side and a second side, wherein the first portion is comprised of a plurality of contiguous polygons being open on the first side and substantially closed on the second side with a perforation through the second side, and wherein the second portion is comprised of a plurality of contiguous polygons being open on the second side and substantially closed on the first side, with a perforation through the first side;

a channel bracket, the channel bracket comprising a polygonal boss on a first side configured to mate with one of the plurality of contiguous polygons of the vertical support, and a projection on the first side configured to mate with the perforation, the channel bracket further comprising a first groove formed in a second side and a second groove formed in a third side, the second side being opposite the third side; and a spa panel retention member comprising a projection to mate in the first groove or the second groove of the channel bracket.

13. The spa support system of claim 12, wherein the spa panel retention member comprises a project to mate in the first groove and the second groove of the channel bracket.

14. A system for supporting a spa, the system comprising:

a vertical support having a top and a bottom;

a first vertical attachment member for attachment to a spa shell;

a second vertical attachment member having a top side and a bottom side, the top side for attachment to the first vertical attachment member and the bottom side for removable attachment to the top of the vertical support, the removable attachment between the bottom side of the second vertical attachment member and the top of the vertical support allowing the vertical support to move in a plane perpendicular to a sidewall of the spa; and a third vertical attachment member having a top side and a bottom side, the top side for removable attachment to the bottom of the vertical support.

15. The system for supporting a spa of claim 14, wherein the vertical support is selectively removable from a spa structure.

16. The system for supporting a spa of claim 14, wherein the vertical support is formed of a plurality of connected hex cells.

17. The system for supporting a spa of claim 14, wherein a connection between bottom side of the second vertical attachment member and top of the vertical support comprises a tongue and groove connection.

18. The system for supporting a spa of claim 17, further comprising at least one channel bracket, the channel bracket comprising a shaped boss on a first side and a first groove formed in a second side.

19. The system for supporting a spa of claim 18, further comprising a spa panel retention member, the spa panel retention member comprising a projection to mate in the first groove of the channel bracket.

20. The system for supporting a spa of claim 19, wherein the projection to mate in the first groove of the channel bracket comprises a cylindrical rib extending from a base of the channel bracket.

* * * * *